US006107552A

United States Patent [19]

Coomar et al.

[11] Patent Number: 6,107,552

[45] Date of Patent: Aug. 22, 2000

[54] SOUNDBOARDS AND STRINGED INSTRUMENTS

[75] Inventors: Ashvin R. Coomar; John A. Decker, Jr., both of Wailuku, Hi.

[73] Assignee: Kuau Technology, Ltd., Kihei, Hi.

[21] Appl. No.: 09/205,134

[22] Filed: Dec. 3, 1998

[51] Int. Cl.[7] ..... G10D 3/00

[52] U.S. Cl. ..... 84/291; 84/192; 84/193; 84/452 P

[58] Field of Search ..... 84/291, 452 P, 84/192, 193

[56] References Cited

U.S. PATENT DOCUMENTS

| | | | |
|---|---|---|---|
| 1,602,355 | 10/1926 | Frank . | |
| 2,469,582 | 5/1949 | Strong | 84/293 |
| 3,427,915 | 2/1969 | Mooney | 84/275 |
| 3,474,697 | 10/1969 | Kaman | 84/267 |
| 3,699,836 | 10/1972 | Glasser | 84/291 |
| 3,880,040 | 4/1975 | Kaman | 84/291 |
| 4,084,476 | 4/1978 | Rickard | 84/293 |
| 4,090,427 | 5/1978 | Kaman | 84/291 |
| 4,213,370 | 7/1980 | Jones | 84/291 |
| 4,313,362 | 2/1982 | Lieber | 84/267 |
| 4,353,862 | 10/1982 | Kaman, II | 264/571 |
| 4,364,990 | 12/1982 | Haines | 428/218 |
| 4,408,516 | 10/1983 | John | 84/275 |
| 4,429,608 | 2/1984 | Kaman et al. | 84/291 |
| 4,969,381 | 11/1990 | Decker, Jr. et al. | 84/291 |
| 5,333,527 | 8/1994 | Janes et al. | 84/291 |

OTHER PUBLICATIONS

Decker, Jr., "Graphite–Epoxy Acoustic Guitar Technology", MRS Bulletin, vol. XX:36–39, Mar. 1995.

Rainsong Graphite Guitars, advertising literature, no date available.

Unexamined Japanese Patent Application, 59–90205, Sep. 18, 1984.

Miner, "Fibrous Reinforcements—Aramid", Modern Plastics Encyclopedia, 1986–1987, pg. 132–140.

*Primary Examiner*—Bentsu Ro
*Assistant Examiner*—Shih-yung Hsieh
*Attorney, Agent, or Firm*—Fish & Richardson P.C.

[57] ABSTRACT

A stringed instrument soundboard is provided, including composite structure that includes first and second opposed layers of a stiffened graphite sheet material and a low-density core material interposed between the first and second opposed layers. Methods of making the soundboard and stringed instruments including the soundboard are also provided.

20 Claims, 4 Drawing Sheets

SOUNDBOARDS AND STRINGED INSTRUMENTS

BACKGROUND OF THE INVENTION

This invention relates to stringed instrument soundboards, to stringed instruments containing such soundboards, and to methods of making the soundboards.

It is desirable that a stringed instrument be as lightweight as possible, as an incremental increase in weight degrades the loudness and tonal quality of the instrument. Generally, it has been necessary to internally brace the soundboard (e.g., soundboard 14, FIGS. 1 and 1A) of the instrument, as wooden soundboards that are made thin enough to provide good sound are not sufficiently stiff to withstand string tension without buckling, distortion or even structural failure. Internal bracing adds weight and also adds complexity and cost to the manufacturing process.

When manufacturing a stringed instrument, the luthier (stringed instrument maker) strives to obtain the finest sound quality possible, while also producing an instrument having a fine surface finish and attractive appearance. These goals tend to be conflicting, as the surface coatings, e.g., varnishes and lacquers, that are applied to obtain an attractive, glossy surface generally detract from the sound quality of the instrument by adding weight and additionally producing tonal distortion.

Obtaining a fine surface finish also tends to be very labor-intensive. Traditionally, luthiers have repaired surface defects and porosity by manually filling defects and pores with a filling resin, e.g., by dipping a toothpick in the resin and daubing the toothpick on each defect, sanding the surface smooth, applying a varnish, and polishing the surface. Each of these steps may have to be repeated several times for each of hundreds of defects to obtain a high quality surface finish.

Other alternative methods of obtaining a smooth surface with non-wood materials, such as curing a composite material under autoclave conditions, or applying a gel coat to the mold, are generally expensive and/or result in unacceptable tonal quality.

SUMMARY OF THE INVENTION

The invention features stringed instrument soundboards having exceptionally light weight and high strength. Preferred soundboards are sufficiently strong to withstand string tension during use, without the conventional internal bracing described above. Preferred soundboards also have high surface gloss and an attractive appearance without surface coatings.

In general, in one aspect, the invention features a stringed instrument soundboard that includes a composite structure including first and second opposed layers of a stiffened graphite sheet material, and a low-density core material interposed between the first and second opposed layers.

Implementations of the invention may include one or more of the following features. The soundboard has a thickness of less than 5 mm, more preferably from about 3.8 to 4.3 mm. The soundboard has sufficient structural integrity to withstand normal use in the stringed instrument without additional bracing (i.e., bracing other than the reinforcement provided by the core). The graphite sheet material comprises a woven material, and is resin impregnated, e.g., with epoxy resin. The low-density core material is a foam. The soundboard includes a sound hole extending through the thickness of the soundboard, and a region surrounding the sound hole that does not include the core material. The composite material has a density of less than about 4 lb/ft$^3$. The stiffened graphite sheet material provides an outer surface of the composite structure that is substantially free of surface coatings. The composite structure consists essentially of a single layer of resin-impregnated graphite sheet material disposed on each side of the low-density core material.

In general, in another aspect, the invention features a stringed instrument, e.g., a guitar, that includes (a) a soundboard formed of a composite material including opposed layers of a stiffened graphite sheet material and a low-density core material interposed between the opposed layers; (b) strings extending along the length of the soundboard; and (c) a stringed instrument body on which the soundboard is mounted.

In yet another aspect, the invention features a stringed instrument comprising a composite material including a surface layer comprising a resin-impregnated woven graphite sheet material, the surface layer defining the outer surface of the stringed instrument and being substantially free of surface coatings.

Implementations of this aspect of the invention may include one or more of the following features. The surface layer has a high gloss. The surface layer is substantially flawless, as defined below. The resin-impregnated sheet material contains less than 45% resin by weight. A body portion of the instrument further includes an underlying layer of resin impregnated unidirectional graphite sheet material laminated to the surface layer. The body portion includes a plurality of these underlying unidirectional layers. A soundboard portion of the instrument further includes a low-density core, a first surface of which is laminated to the surface layer and a second, opposed surface of which is laminated to an inner layer of resin impregnated graphite sheet material.

The invention also features methods of making soundboards and stringed instruments. The methods include (a) providing a mold having a molding surface defining the shape of at least a portion of the stringed instrument or of the soundboard, the mold surface of the molding cavity having a highly polished surface; and (b) molding, in the mold, a composite material including a surface layer, placed adjacent the mold surface, including a resin-impregnated woven graphite sheet material. Surprisingly, it has been found that by molding a woven resin impregnaterd sheet material against a very smooth mold surface, the stringed instrument can be provided, as molded, with a high degree of surface gloss and highly aesthetic surface properties without requiring any additional coating.

In some methods, the molding step includes laying up opposed layers of the resin-impregnated woven graphite sheet material and interposing between the opposed layers a low-density core material.

The term "substantially flawless", as used herein, means that a 5000 square centimeter surface has no flaws larger than 0.5 mm, fewer than 3 flaws between 0.1 mm and 0.5 mm, and fewer than 30 flaws smaller than 0.1 mm. A flaw is a pit, bubble, pore, scratch or blemish.

Among the advantages of the invention are one or more of the following. The soundboards require neither the application of internal bracing nor the application of surface coatings. Very few, if any, flaws remain to be repaired on the molded soundboard and body, which can yield a labor reduction of, e.g., from up to 80 hours per instrument using conventional manufacturing techniques, to approximately 25 hours per instrument using the methods of the invention.

Because neither bracing nor surface coatings are required, a stringed instrument including the soundboard is lightweight and has excellent tonal quality. In addition, manufacturing of the stringed instrument is relatively simple, the stringed instrument can be mass-produced, and product quality is generally consistent from one instrument to another. Stringed instruments of the invention are also resistant to damage from impact, moisture, and temperature changes.

Other advantages and features will become apparent from the following description and from the claims.

DESCRIPTION OF THE PREFERRED EMBODIMENTS

Figure 1:
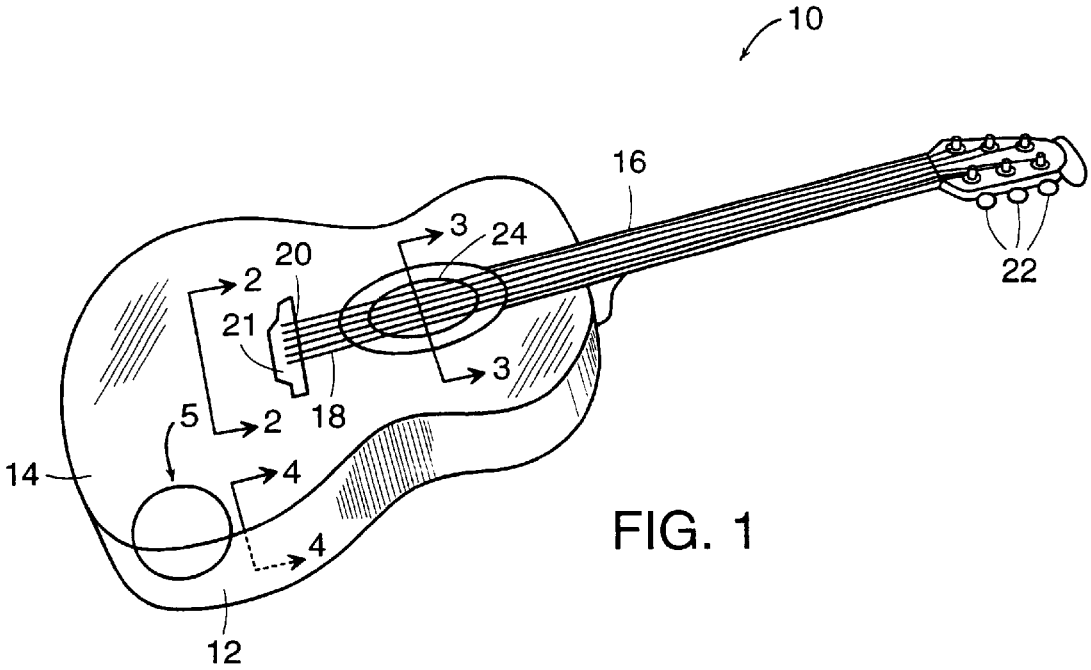
FIGS. 1 and 1A are perspective views of, respectively, a guitar and a violin.
Figure 1A:
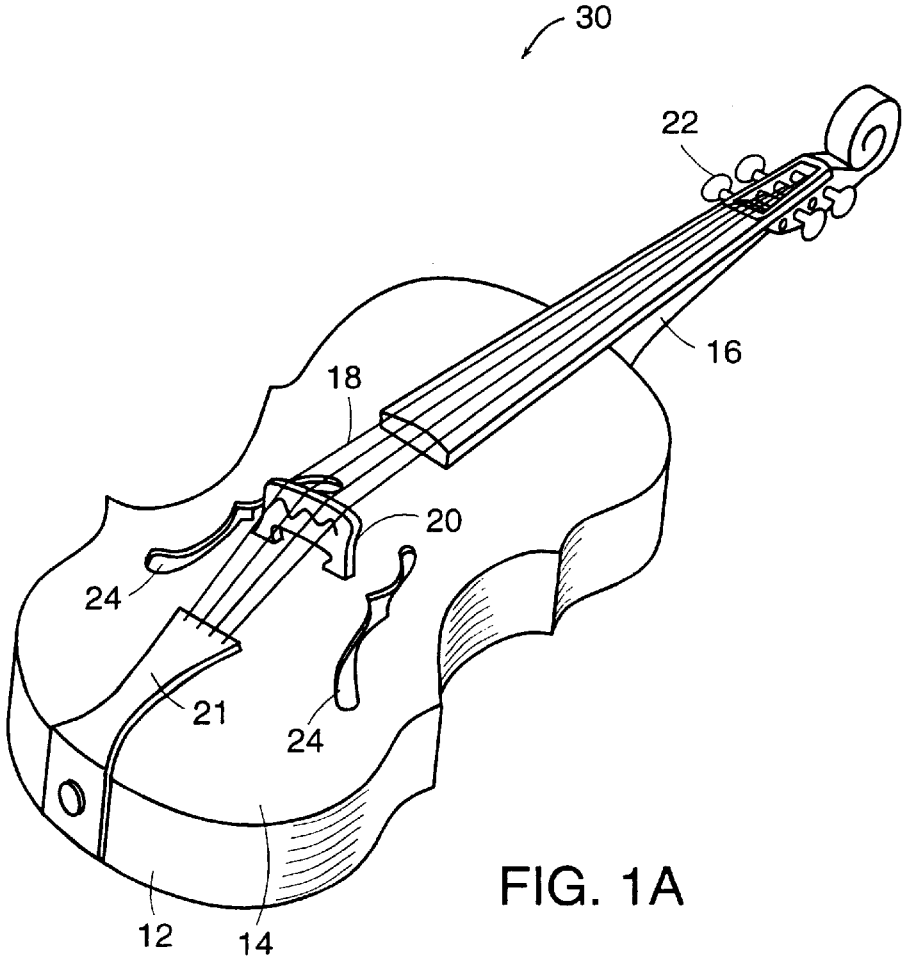

Referring to FIG. 1, a guitar 10 includes a hollow guitar body 12, a flat soundboard 14 joined to the top edge of the guitar body 12, and a neck 16 extending from the guitar body 12. A bridge 21 that is mounted on the soundboard 14, e.g., with bolts and/or adhesive, holds strings 18 and saddle 20 in a position that defines string length. Strings 18 are tensioned between the bridge 20 and tuning pegs 22 at the end of neck 16. Guitar 10 also includes a soundhole 24 that extends through the thickness of the soundboard 14 and communicates with the hollow interior of guitar body 12. The violin shown in FIG. 1A includes similar components, which are numbered correspondingly. (Component 21 that mounts the violin strings to the violin body is generally referred to as a "tailpiece".)

When the guitar 10 or violin 30 is properly tuned, the tension on strings 18 exerts a significant force on soundboard 14, e.g., typically about 190 lbs. for a 6-string guitar and about 400 lbs. for a 12 string guitar, tending to bow the soundboard out of its intended shape and requiring the soundboard to have good structural integrity and resistance to buckling and distortion. Soundboard 14 is not reinforced with internal braces; instead, soundboard 14 itself has sufficient structural integrity to withstand string tension without distortion or buckling. While some slight distortion may occur, the distortion is not sufficient to cause the bridge to rotate significantly, which would change the string length. In preferred soundboards the distortion is less than 0.5 mm (measured as the sinking or bowing of the soundboard on either side of the bridge).

Figure 2:
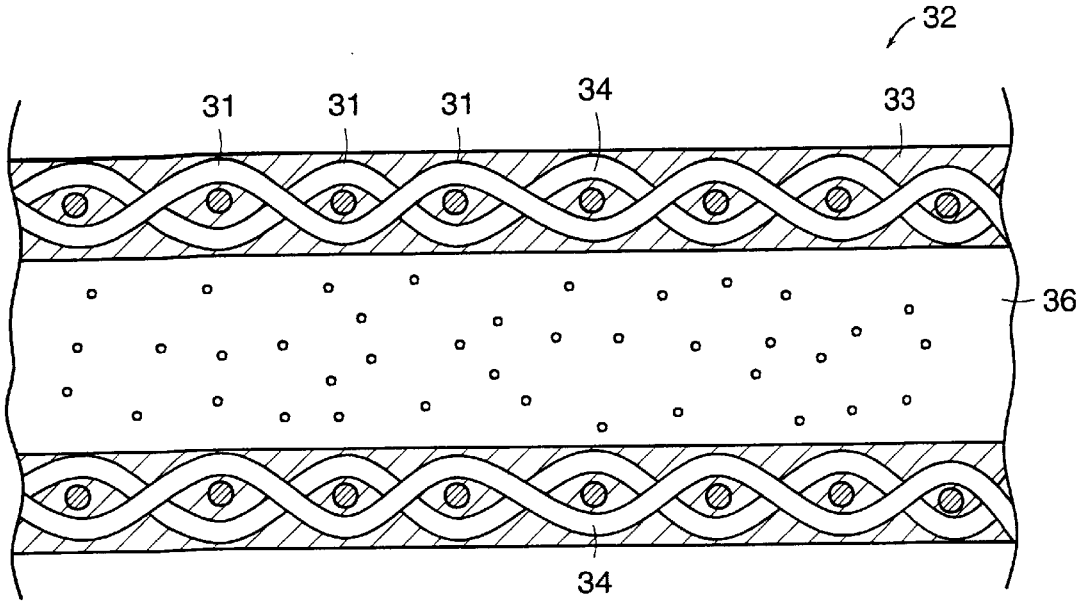
FIG. 2 is a highly enlarged partial cross-sectional view of the soundboard of the guitar, taken along lines 2—2 in FIG. 1.

The soundboard 14 is constructed of a composite material 32, the structure of which is shown diagrammatically in FIG. 2. Composite material 32 includes two opposed layers 34 of a resin impregnated woven graphite sheet material that includes woven fibers 31 and resin 33. Layers 34 are laminated to a rigid low-density foam core 36. Foam core 36 serves as a spacer between the layers of resin impregnated sheet material, creating an "I-beam" construction that has a high stiffness and resistance to distortion or buckling under string tension.

Preferably, composite material 32 has a density of less than 0.3 g/cm$^3$, more preferably less than 0.25 g/cm$^3$. It is also preferred that only a single layer of sheet material be used on each side of the foam core, as shown, to minimize the weight of the composite material. The weight of a soundboard of the invention, for a 6-string acoustic guitar, is from about 140 to 170 grams, more preferably approximately 165 grams. By comparison, conventional wood soundboards for this type of guitar generally have a weight of at least 225 grams, with the required bracing typically contributing about 50 to 75 grams of the total 225 grams.

Suitable graphite sheet materials are those which, when impregnated with resin and cured, will impart a desired surface finish to the soundboard and provide adequate reinforcement to the foam core. It is preferred that both layers be woven, as shown in FIG. 2 and described above, as woven graphite provides fewer surface defects than unidirectional graphite and is generally less expensive. However, if desired, the graphite sheet material that faces the interior of the stringed instrument may be a unidirectional material. The graphite sheet material is impregnated with a resin, e.g., a pre-catalyzed epoxy resin such as LTA 25NC, commercially available from Advanced Composites Group Inc., 5350 S. 129th E. Ave, Tulsa, Okla. 74154. Preferred resins cure at relatively low temperatures and, when cured, impart strength to the composite. The area density of the impregnated graphite sheet material is preferably from about 300 to 500 g/m$^2$. Suitable impregnated graphite sheet materials are commercially available, e.g, LTM24ST, CFO308 2×2 twill weave from Advanced Composites Group, Inc. For optimal sound quality, it is preferred that the resin impregnated graphite sheet material have a relatively low resin-to-fiber ratio, e.g., less than 45% and more preferably less than 40%.

Suitable foam core materials are those which, when combined with layers 34, are sufficiently rigid to provide the necessary structural integrity to the soundboard, and which are sufficiently thin and low density to provide the soundboard with good tonal quality. The foam should also be compatible with the resin used in the resin impregnated sheet material, and preferably will not absorb so much of the resin during curing that the sheet material will be starved of resin. Preferred foams are not overly acoustically absorbing. A suitable foam is rigid polyvinyl chloride (PVC). Preferred foams have a density of less than 4.0 lb/ft$^3$, and a thickness of from about 0.1 to 0.2 inches. Thinner foams may not have sufficient strength to withstand processing, while thicker foams may make the soundboard overly stiff, compromising its acoustical properties. Suitable foams are commercially available, e.g., from Divinylcell International, Inc., 315 Seahawk Drive, Desoto, Tex. 75115 under the tradename "KLEGECELL".

It is preferred, but not required, that the soundboard include only the three layers shown in FIG. 2, to avoid excess weight and tonal distortion that could be introduced by additional layers. However, it may be desirable to further include a thin layer of resin film between the mold-facing resin impregnated layer and the foam core, in order to minimize "print through" of the edge of the foam core onto the soundboard surface caused by resin absorption by the core. A suitable resin film is LTA25NC resin film, 170 g/m$^2$, Advanced Composites Group.

Figure 3:
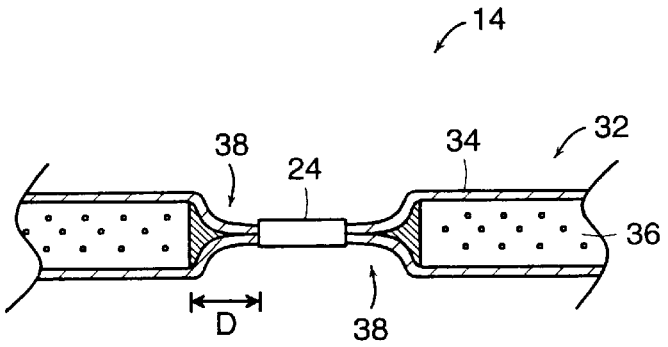
FIG. 3 is a highly enlarged partial cross-sectional view of the soundboard of the guitar, taken along lines 3—3 in FIG. 1.
Figure 4:
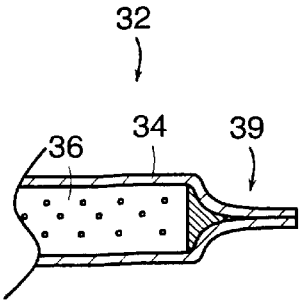
FIG. 4 is a highly enlarged partial cross-sectional view of the soundboard of the guitar, taken along lines 4—4 in FIG. 1.
Figure 5:
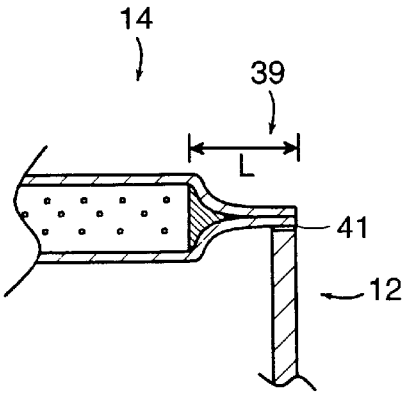
FIG. 5 is a detail cross-sectional view of area 5 of FIG. 1.

As shown in FIG. 3, the soundboard 14 includes a region 38, surrounding soundhole 24, that does not include the foam core 36. This region has a radial dimension D of from about 0.5 to 1.0 inch. Region 38 provides a smooth, durable edge to the soundhole. Preferably, as shown in FIG. 4, the periphery of the soundboard, where the soundboard is joined to the guitar body, includes a region 39 that, like region 38 discussed above, does not include the foam core. This region has a length L of from about 0.5 to 1.5 inches. This foam-free region provides a durable edge that can be readily joined to the body of the guitar and allows acoustic pivoting at the edge joint. As shown in FIG. 5, the soundboard 14 is joined to guitar body 12 by adhesive bond 41.

The guitar body 12 is also preferably formed of a composite material. The guitar body is not subjected to nearly as much bowing force as the soundboard, and as a result the composite material used in the guitar body 12 does not require a reinforcing foam core. If desired, the guitar body can be formed of a composite that includes only an outer layer of the resin impregnated woven graphite sheet material described above, and one or more layers of resin impregnated unidirectional graphitsheet material in whe., sheet material in which the graphite fibers run in one direction only, underlying the outer layer. The outer layer provides a glossy surface finish, while the underlying layers provide reinforcement. However, it is preferred that at least the back portion of the guitar body include a foam layer, as discussed above, between the outer layer and underlying layers. The back portion of the guitar body generally includes several unidirectional layers, e.g., two to four layers, layed up in different relative orientations to enhance the strength of the composite material.

To manufacture a stringed instrument of the invention, the layers described above are laid up in a mold and cured, under vacuum, at a temperature and for a time sufficient to cure the impregnating resin and laminate the layers together. For example, if the preferred materials discussed above are used, the composite would be vacuum bagged at 1 atm pressure and cured using one of the following cure cycles: about 140° F. for about 9–10 hours; about 120° F. for about 16 hours; about 175° F. for about 4–5 hours. Advantageously, it is not necessary to cure the composite under high pressure (autoclave) conditions in order to obtain good resin flow against the mold surface.

It is important that the layer that will form the outer surface of the soundboard or guitar body be layed up directly against the mold surface, and that the mold have a very smooth surface, e.g., glass or a smooth metal such as aluminum. Suitable surfaces are those which are smooth and which are easily wetted by the resin in the composite material under vacuum bag pressures (approx. 1 atm or less) and curing temperatures of less than about 200° F. Using a very smooth mold surface allows the soundboard or guitar body to have a very smooth, glossy surface straight from the mold. Preferably, a mold release is applied to the surface and the surface is buffed well prior to molding. A preferred mold release for use with the particular composites discussed above is #82505 Premium Clear Coat Wax, available from Norton, Automotive Sales, Worcester, Mass. 01606. The smooth mold surface has been found to eliminate the need to apply in-molding surfacing resins (gel coats). Gel coats are conventionally used in the molding industry to provide molded articles with smooth surfaces, but would tend to add unacceptable weight or create surface defects if used in the manufacture of a stringed instrument. Moreover, it is not necessary to apply surface coatings to the molded composite, nor is it necessary to perform additional manufacturing steps such as polishing of the surface. The surface of the finished instrument may be lightly buffed, if desired.

EXAMPLE

Figure 6:
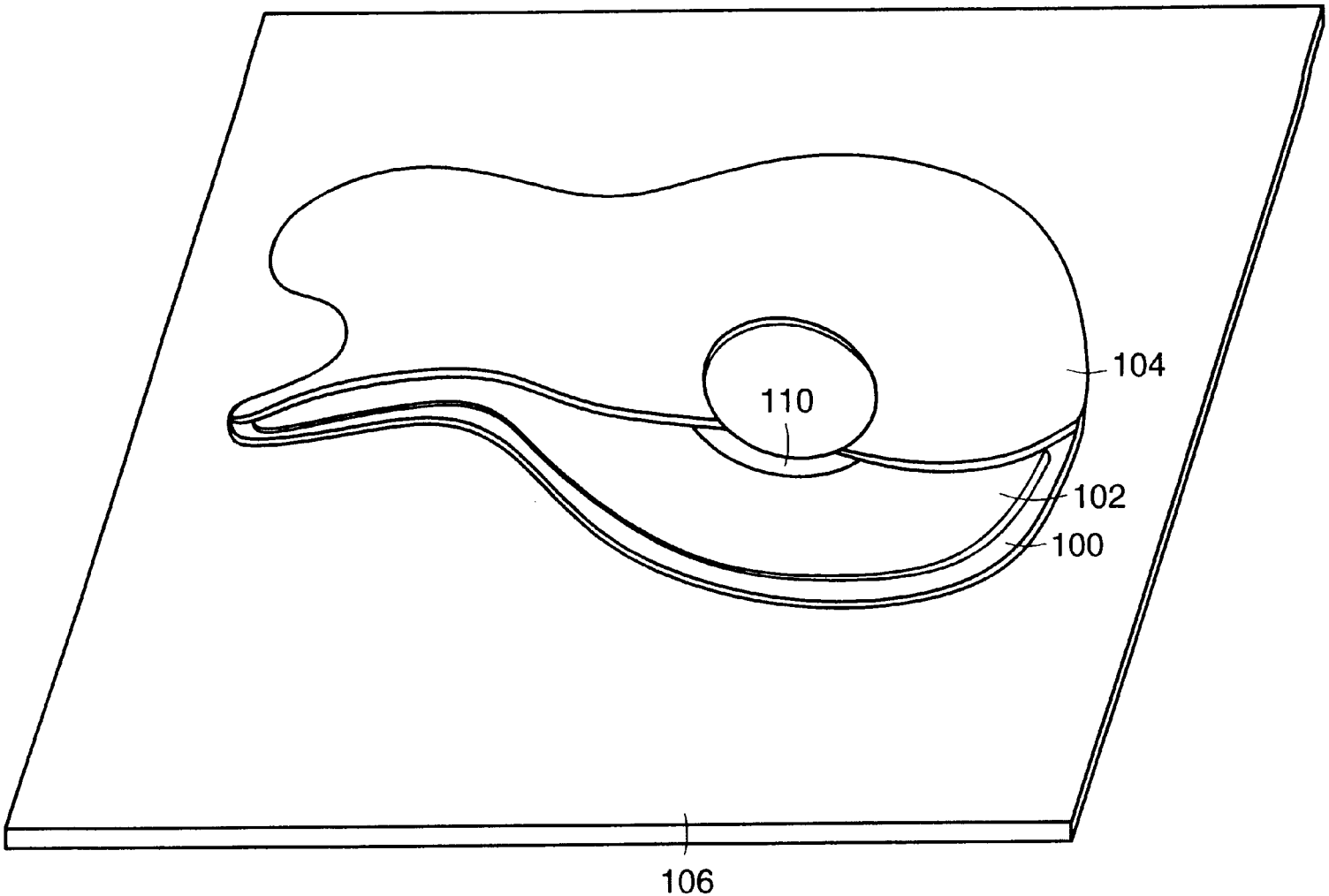
FIG. 6 is a schematic perspective view, partially cut away, showing the layers of the soundboard laid up on a glass mold surface.

A guitar soundboard was manufactured using the following procedure. A tempered glass sheet was coated with 4 layers of #82505 Premium Clear Coat Wax mold release and buffed. A layer of a woven resin impregnated graphite material (LTM24ST, CFO308 2×2 twill weave @ ‰ degree orientation, 199 g/m$^2$, 40% resin by weight, flexural strength 140 ksi, flexural modulus 8.4 msi) was cut to the desired shape and size of the soundboard and laid up directly on the surface of the glass sheet. A layer of resin film (LTA25NC, 170 g/m$^2$, Advanced Composites Group) was cut to the same size and shape and laid up on the resin impregnated graphite layer. A piece of foam (KLEGECELL rigid PVC foam, 0.125" thick, 4 lbs/ft$^3$) was cut to the same size and shape as the resin impregnated graphite layer, less a 1" border, and laid up on top of the resin film. A second layer of the a woven resin impregnated graphite material (LTM22, CF0100 4×4 twill weave @ ‰ degree orientation, 280 g/m$^2$, 41% resin by weight, flexural strength about 140 ksi, flexural modulus about 8.4 msi) was then cut to the same size and shape as the first resin impregnated graphite layer and laid up on top of the foam layer. As shown in FIG. 6, the three layers (woven material 100, foam 102 and woven material 104) were aligned on glass mold surface 106 so that the two graphite layers were in registration and formed a 1" border 110 around the periphery of the foam layer. The three layers were then vacuum bagged at 1 atm and cured for 9 hours at 140° F.

Figure 7:
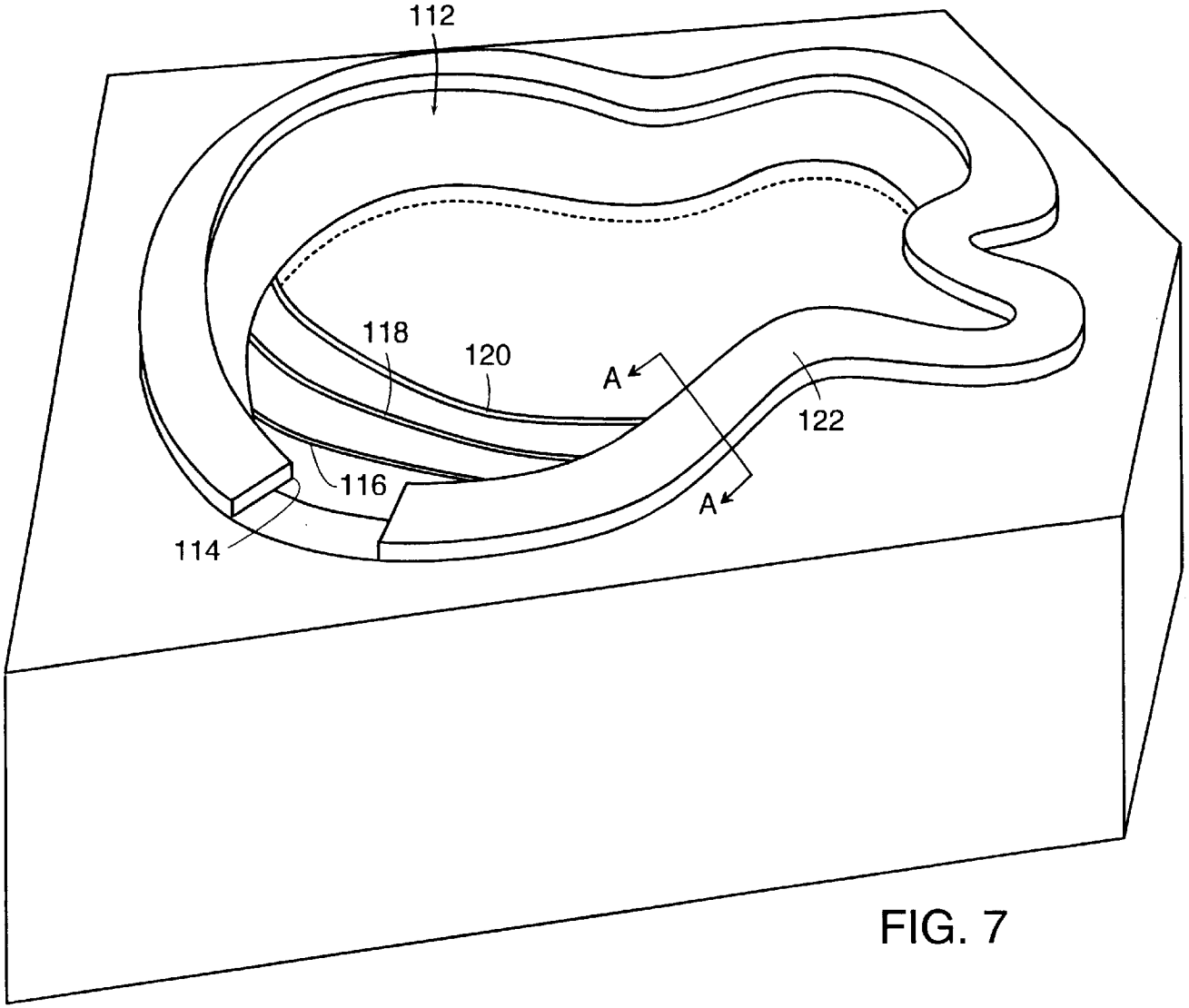
FIG. 7 is a schematic perspective view, partially cut away, showing the layers of the guitar body laid up in a mold cavity.

A guitar body was then manufactured using the following procedure. A guitar-body-shaped aluminum mold 112 (FIG. 7) was treated with mold release as described above. For the back, a layer of a woven resin impregnated graphite material (LTM24ST, CFO108 4×4 twill weave @ ‰ degree orientation, 280 g/m$^2$, 36% resin by weight, flexural strength 140 ksi, flexural modulus 8.4 msi) was cut to the desired shape and size of the guitar back and laid up directly on the surface of the mold bottom. A layer of resin film (LTA25NC, 170 g/m$^2$, Advanced Composites Group) was cut to the same size and shape and laid up on the resin impregnated graphite layer. A piece of foam (KLEGECELL rigid PVC foam, 0.125" thick, 4 lbs/ft$^3$) was cut to the same size and shape as the resin impregnated graphite layer, less a 1" border, and laid up on top of the resin film. A second layer of a woven resin impregnated graphite material (LTM22, CF0100 4×4 twill weave @ ‰ degree orientation, 280 g/m$^2$, 41% resin by weight, flexural strength about 140 ksi, flexural modulus about 8.4 msi) was then cut to the same size and shape as the first resin impregnated graphite layer and laid up on top of the foam layer. As shown in FIG. 7, the three layers (woven layer 114, resin film 116, foam 118 and woven layer 120) were aligned so that the two graphite layers were in registration and formed a 1" border (indicated by dotted lines in FIG. 7) around the periphery of the foam layer. The outer layer was bookmatched for aesthetic purposes.

Figure 7A:
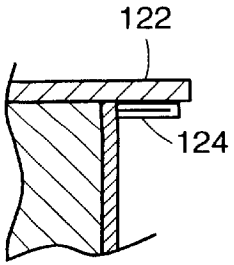
FIG. 7A is a partial cross-sectional view of the mold taken along line A—A in FIG. 7.

For the sides, a layer of a woven resin impregnated graphite material (LTM24ST, CFO0100 4×4 twill weave @ ‰ degree orientation, 280 g/m$^2$, 36% resin by weight, flexural strength 140 ksi, flexural modulus 8.4 msi) was cut to a strip having the desired shape and size to form the guitar sides and laid up directly against the side surface of the mold. Two layers of a woven resin impregnated graphite material (LTM22, CF0100 4×4 twill weave @ ‰ degree orientation, 280 g/m$^2$, 41% resin by weight, flexural strength about 140 ksi, flexural modulus about 8.4 msi) were then cut to the same size and shape as the first resin impregnated graphite layer and laid up on top of it. All of the layers were cut to about 0.5 inch above the top of the side wall of the mold. The excess material was then bent at a right angle by mold cap 122, as shown in FIG. 7A, to form a ledge 124 to which the soundboard can be readily bonded.

The resulting lay-up was then vacuum bagged at 1 atm and cured for 9 hours at 140° F.

The soundboard was bonded to the guitar body using PTM&W ES6271 epoxy adhesive, PTM&W Industries, Inc., 10640 S. Painter Ave., Sante Fe Springs, Calif. 90670, to form an assembled guitar. No internal bracing was applied to the soundboard. Strings were then mounted on the guitar in a conventional manner. The guitar exhibited good sound quality with exceptional loudness and presence, very full base, clear treble and good balance across the tonal range. No distortion or buckling was observed after playing. The guitar's finish was fully acceptable out-of-the-mold, without the application of a surface coating or finish, or any flaws that required filling.

Other embodiments are within the claims.

For example, while guitars and violins have been shown and discussed above, the soundboard of the invention can be used in any type of stringed instrument, for example dobros, mandolins, ukeleles and lutes.

Moreover, while a guitar having a soundhole is shown in FIG. 1, some implementations of the invention include soundboards that do not have a soundhole or have multiple soundholes.

Additionally, the core of the composite material need not be a foam material, but can be any material that is capable of acting as a spacer between the sheet material layers, is sufficiently light, is compatible with the resin used in the sheet material and will not absorb an excessive amount of the resin during curing, has suitable acoustical properties (i.e., is relatively acoustically non-absorbing), and is capable of withstanding curing conditions without excessive deterioration.

What is claimed is:

1. A stringed instrument soundboard comprising a composite structure, comprising first and second opposed layers of a stiffened graphite sheet material and a low-density core material interposed between the first and second opposed layers.

2. The stringed instrument soundboard of claim 1 wherein said soundboard has a thickness of less than 5 mm.

3. The stringed instrument soundboard of claim 2 wherein said soundboard has a thickness of from about 3.8 to 4.3 mm.

4. The stringed instrument soundboard of claim 1 wherein said graphite sheet material comprises a woven material.

5. The stringed instrument soundboard of claim 1 wherein said graphite sheet material is resin impregnated.

6. The stringed instrument soundboard of claim 1 wherein said low-density core material comprises a foam.

7. The stringed instrument soundboard of claim 5 wherein said resin comprises epoxy resin.

8. The stringed instrument soundboard of claim 1 further comprising at least one sound hole extending through said soundboard.

9. The stringed instrument soundboard of claim 8 further comprising a region surrounding said sound hole that does not include said core material.

10. The stringed instrument soundboard of claim 1, wherein said composite material has a density of less than about 0.25 g/cm$^3$.

11. The stringed instrument soundboard of claim 1, wherein said stiffened graphite sheet material provides an outer surface of said composite structure that is substantially free of surface coatings.

12. The stringed instrument soundboard of claim 1 wherein said composite structure consists essentially of a single layer of resin-impregnated graphite sheet material disposed on each side of said low-density core material.

13. A stringed instrument comprising a self-supporting soundboard formed of a composite material comprised of first and second layers of a stiffened graphite sheet material and a low-density core material interposed between the layers;

strings extending along the length of said soundboard; and a hollow stringed instrument body on which said soundboard is mounted;

wherein said soundboard has sufficient structural integrity to permit it to be attached to the hollow body of the stringed instrument to form a sound box, without requiring bracing.

14. The stringed instrument of claim 13 wherein the stringed instrument comprises a guitar.

15. The stringed instrument of claim 13 wherein said composite material has a density of less than about 0.25 g/cm$^3$.

16. The stringed instrument of claim 13 wherein said stiffened graphite sheet material provides an outer surface of said composite structure that is substantially free of surface coatings.

17. The stringed instrument of claim 13 wherein said stiffened graphite sheet material comprises a woven, resin-impregnated graphite fabric.

18. The stringed instrument of claim 13 wherein said low-density core material comprises a foam.

19. A stringed instrument soundboard comprising a composite structure, comprising first and second opposed layers of an epoxy resin-impregnated woven graphite sheet material and a rigid low-density foam core material interposed between the first and second opposed layers, wherein said soundboard has a thickness of less than 5 mm, sufficient structural integrity to withstand normal use in said stringed instrument without additional bracing, and a density of less than 0.25 g/cm$^3$.

20. A stringed instrument comprising a hollow body having a perimeter edge that defines an open side, a self-supporting soundboard attached to the body along the perimeter edge to form a soundbox, and strings lying adjacent to the soundboard, the soundboard being formed of a composite material comprised of layers of a stiffened graphite sheet material and a low-density core material interposed between the layers, the soundboard spanning the open side and supporting itself without structural support by any bracing element.

* * * * *